United States Patent [19]

Merisio

[11] 4,076,054

[45] Feb. 28, 1978

[54] WEFT PRESENTING DEVICE FOR LOOMS WITH SELECTIVE WEFT FEED

[75] Inventor: Alberto Merisio, Colzate (Bergamo), Italy

[73] Assignee: Somet Societa' Meccanica Tessile S.p.A., Gazzaniga (Bergamo), Italy

[21] Appl. No.: 729,366

[22] Filed: Oct. 4, 1976

[30] Foreign Application Priority Data

Oct. 3, 1975 Italy ..... 27928/75

[51] Int. Cl.[2] ..... D03D 47/34

[52] U.S. Cl. ..... 139/453

[58] Field of Search ..... 139/450, 453; 66/127

[56] References Cited

U.S. PATENT DOCUMENTS

| | | | |
|---|---|---|---|
| 3,364,954 | 1/1968 | Kokkinis | 139/453 |
| 3,409,053 | 11/1968 | Higgins et al. | 139/453 |
| 3,511,284 | 5/1970 | Tosches | 139/453 |
| 3,587,665 | 6/1971 | Monge | 139/453 |

*Primary Examiner*—Henry S. Jaudon
*Attorney, Agent, or Firm*—Young & Thompson

[57] ABSTRACT

A weft presenting device for looms with selective weft feed, of the type wherein presenting rods are operated one at a time by respective control magnets, so as to be ejected from the device itself for presenting their own weft thread, provides for each single rod to be positively controlled, during both its advancing and its return motion, by a mechanism controlled by a cam, wherein a pawl interlocked with the control magnet locks, when energized, the end of a lever of said mechanism, to impose on said lever the movements for operating the back and forth motions of the rod; while, when de-energized, said pawl frees the end of said lever, allowing the same to perform idle movements.

5 Claims, 2 Drawing Figures

WEFT PRESENTING DEVICE FOR LOOMS WITH SELECTIVE WEFT FEED

BACKGROUND OF THE INVENTION

The present invention relates to an improved weft presenting device for use in looms with selective weft feed, which weave with a stationary weft supply from which the thread is intermittently drawn into successive sheds.

In the field of weaving machines, devices are already known to carry out the presenting of weft threads to the members (usually grippers) for gripping and carrying the threads into the shed of weaving looms of the so-called type with weft feed. Such devices — better known as presenting devices — are substantially meant to arrange one at a time, for being gripped by the gripping member, the various weft threads — usually of different characteristics and especially of different colours — forming the fabric on the loom. For this purpose, the presenting devices generally comprise a plurality of presenting members formed by rods the tipped end of which is crossed, through an appropriate hole, by the thread to be presented. Usually, such rods are arranged parallel to one another, partially contained inside a case from which they come out, one at a time, to present their own weft thread close to the gripping and carrying member, under the control of an electromagnet, which is in turn energized by the selection devices which form the pattern of the fabric being woven in the loom. As a matter of fact, the known presenting devices carry out only a partial presenting of the selected weft thread, which they separate from the other threads, causing it to advance close to the gripping and carrying member; the presenting operation is then completed by a hook, which grips the thread carried by the rod projecting from the presenting device and appropriately deviates the path of said thread, to allow it to be grasped by the gripping and carrying member. In the known presenting devices, the return of the rods to a rest position is controlled by a return spring, with all the drawbacks deriving from a control of this type, said drawbacks becoming all the more serious — with further negative effects on the regular running of the loom — when trying to increase the loom working speed, as happens in the most modern of such weaving machines.

The object of the present invention is to provide an improved presenting device, suited for modern looms with a high number of beatings up per minute, eliminating, on one hand, the drawbacks deriving from the spring return of the presenting rods, and making it possible, on the other hand, to simplify the operation of presenting the weft, by avoiding the use of the hook.

SUMMARY OF THE INVENTION

Said presenting device is essentially characterized by the fact that each single rod is positively controlled, during both its advancing motion and its return motion, by a mechanism controlled by a cam, wherein a pawl interlocked with the control magnet locks, when energized, the end of a lever of said mechanism, to impose on said lever the movements for operating the to and fro motions of the rod; while, when de-energized, said pawl frees the end of said lever, allowing the same to perform idle movements.

Said presenting device is further characterized by the fact that the various rods are mounted converging towards an area, which is so close to the area where the weft threads have to be presented, that said threads may be fed by such rods directly to the gripping and carrying member.

According to a preferred embodiment of the present invention, the mechanism for controlling the rods comprises: a cam; a rocker arm oscillating about an intermediate point and engaging said cam with one end; a connecting rod which connects the other end of said rocker arm with a point close to the end of an oscillating lever; and a pawl controlled by an electromagnet, against the action of a return spring, and being adapted to engage said end of the oscillating lever, the other end of which bears, under the action of spring means, against a stop placed on the same side of the rocker arm, said other end of the oscillating lever being connected, by means of a second connecting rod, to the rod to be operated, which is in turn forced to slide along its own longitudinal axis.

BRIEF DESCRIPTION OF THE DRAWINGS

The invention will now be described in further detail, by mere way of example, with reference to the accompanying drawings, which represent a preferred embodiment thereof and in which.

DESCRIPTION OF THE PREFERRED EMBODIMENT

Figure 1:
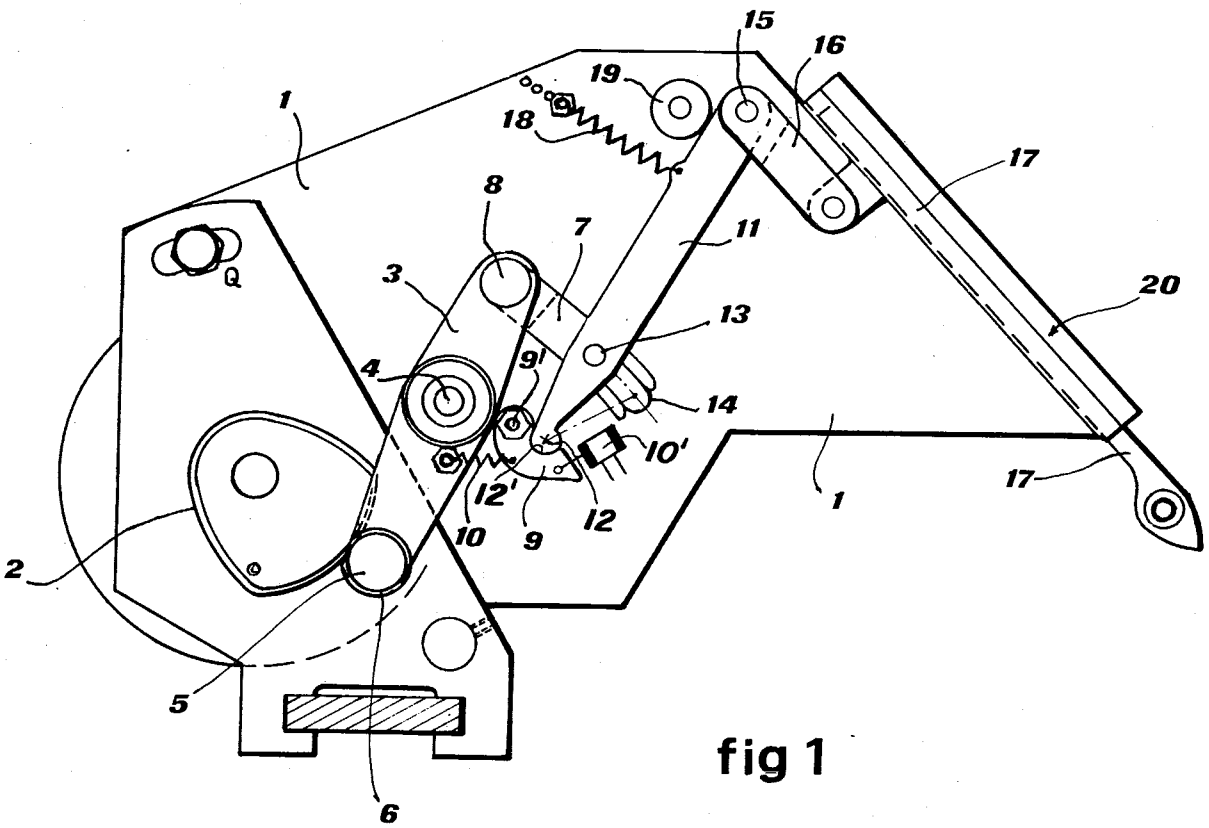
FIG. 1 is a schematic cross-section view through the presenting device according to the invention.

With reference to the accompanying drawings, it can easily be seen that the presenting device according to the invention comprises, within a case 1: a control cam 2 which is caused to rotate by the means operating the loom and whose profile will of course be selected according to the duration and magnitude of the motion to be imparted by the cam; a pair rocker arms 3, pivoted at an intermediate point 4 and the end 5 of which is engaged, through a cam-follower 6, with the cam 2; a pair connecting rods 7, pivoted at one end to the end 8 of the rocker arm 3; a pawl 9, subject to the action of a spring 10 and to that of an electromagnet 10'; a lever 11 having: an end 12 engaged in a recess 12' in the pawl 9; an intermediate point close to the end 12, connected by a pin 13 which extends across case 1 to the other end of the connecting rods 7 and forced to move along a path forming an arc of a circle and illustrated by way of example in the drawing by slot 14 in which pin 13 slides; and an end 15 pivotally connected by means of a connecting rod 16 to the rod 17 to be operated. There are a plurality of rods 17 provided with each being associated with a connecting rod 16, a lever 17, a pawl 9 and an electromagnet $10^1$. Pawls 9 are selected by any common known selecting mechanism whereby electromagnets 10' are actuated by a conventional pattern mechanism. See for example U.S. Pat. No. 3,548,886.

FIG. 1 shows the pawl 9 in the position of engagement with the end 12 of the lever 11, in which position it is driven by the action of the electromagnet 10' for controlling the rod 17. When the action of said electromagnet stops, the spring 10 swings the pawl 9 out of engagement with the end 12 of the lever 11, by causing said pawl to rotate about its pin 9'.

Close to its end 15, the lever 11 is urged by a spring 18, toward a bearing element in the form of a roller or like 19.

The rod 17 is provided with a slideway 20, inside which it is free to slide only along its longitudinal axis, in both directions.

Figure 2:
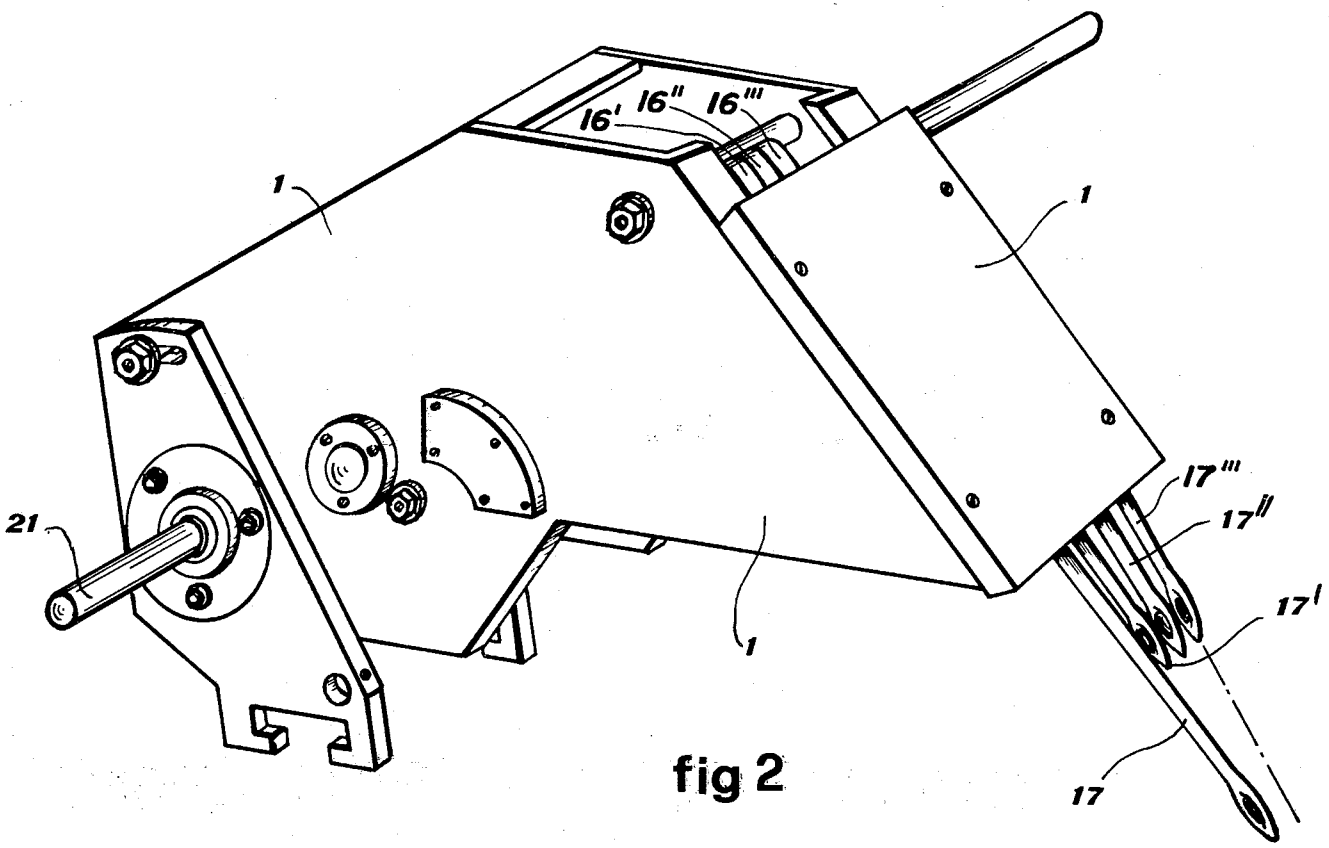
FIG. 2 is an exterior perspective view of the presenting device of FIG. 1.

FIG. 2 of the drawings shows the outside of the presenting device, namely, its case 1, the shaft 21 controlling the rotation of the cam 2, and a group of rods 17, 17', 17'', 17''' controlled by their respective control rods 16, 16;, 16'', 16''', the first of which rods projects from the case 1 in active the advanced position. As can be seen from FIG. 2, the rods are arranged — according to the invention — converging towards an area which is very close to the area where the weft thread has to be gripped by the member carrying the same into the loom shed.

On considering the working of the presenting device according to the invention, it can easily be understood that — with the parts forming said device in the position of FIG. 1 and the control magnet 10' energized — the cam 2 causes the oscillation of the rocker arm 3 and the latter shifts the pin 13 of the lever 11 along the slot 14, through the action of the connecting rod 7. Since the end 12 of the lever 11 is kept stationary by the pawl 9 engaging the same, the lever oscillates about said end and first moves away from, and then draws close again to the bearing element 19, operating — through the connecting rod 16 — first the advance and then the return of the rod 17, which can move only along its own longitudinal axis.

When the control magnet 10' is de-energized, the pawl 9 rotates clockwise about its pivot 9', under the action of the spring 10, and thus frees the end 12 of the lever 11. Then, the motion of the pin 13 — still produced by the rotation of the cam 2 through the rocker arm 3 and the connecting rod 7 — is turned into an oscillation of the lever 11 about its point of contact with the bearing element 19, against which it is held by the spring 18. To said oscillation correspond movements of the connecting rod 16, which are practically of no magnitude, whereby it can well be said that the lever 11 performs, in this condition, an idle movement.

The described arrangement allows to control in a positive way and with great simplicity and safety, the reciprocatory movements of the rod 17. The presenting device according to the invention is hence able to work very efficiently at high and very high speeds, as required in the most modern looms.

It is then easy to understand that, if the various rods 17, 17', 17'' . . . of the presenting device are arranged converging, as explained hereabove and as illustrated in FIG. 2 — which is allowed by the simplicity and linearity of the heretofore mentioned control means for each of said rods — the presenting device will allow to carry out the presenting operation in a complete manner, each of the rods being in a position to arrange the weft thread carried thereby in strict proximity to the area in which said thread has to be gripped by the gripping and carrying member. In doing so, it is possible — by using the presenting device of the present invention — to eliminate the hook designed to complete the presenting operation, thereby evidently simplifying and improving the whole loom and the working thereof.

It is understood that there may be embodiments of the invention other than those described, still falling within the scope of the present invention.

I claim:

1. Apparatus for selectively presenting weft threads into position to be picked up and down into successive sheds of a loom, comprising a plurality of weft thread presenting rods, ånd means for advancing and retracting a selected said rod in the direction of its length, said means comprising, associated with each said rod, a rotary cam, a pawl, a lever connected to a said rod, means interconnecting said cam and said lever for moving a point intermediate the length of said lever through a predetermined path, means for selectively engaging and disengaging one end of said lever with and from said pawl, whereby when said one end of said lever is engaged with said pawl, said lever swings about its said one end and the other end of said lever imparts to the associated said rod a movement of substantial magnitude but when said pawl is disengaged from said one end of said lever said one end of said lever is free to swing relative to said pawl, and means restricting movement of the other end of said lever whereby when said one end of said lever is free to swing, said other end of said lever imparts at most only very small movement to said associated rod.

2. Apparatus as claimed in claim 1, in which said rods converge at their free ends remote from said levers.

3. Apparatus as claimed in claim 1, said selective engaging means comprising an electromagnet that moves said pawl in one direction, and spring means continuously urging said pawl in the opposite said direction.

4. Apparatus as claimed in claim 3, said pawl being mounted on said apparatus for swinging movement into and out of contact with said one end of said lever.

5. Apparatus as claimed in claim 1, said restricting means comprising abutment means adjacent said other end of said lever, and spring means continuously urging said other end of said lever toward said abutment means whereby when said one end of said lever is disengaged from said pawl, said lever swings about said abutment means.

* * * * *